US008727195B2

(12) United States Patent
Takashima

(10) Patent No.: US 8,727,195 B2
(45) Date of Patent: May 20, 2014

(54) BLADE SNAP-OFF HOLDER

(75) Inventor: Yosuke Takashima, Suita (JP)

(73) Assignee: Olfa Corporation, Osaka-shi (JP)

( * ) Notice: Subject to any disclaimer, the term of this patent is extended or adjusted under 35 U.S.C. 154(b) by 138 days.

(21) Appl. No.: 13/361,690

(22) Filed: Jan. 30, 2012

(65) Prior Publication Data

US 2012/0199626 A1 Aug. 9, 2012

(30) Foreign Application Priority Data

Jan. 31, 2011 (JP) ..... 2011-018402

(51) Int. Cl.
*B26F 3/00* (2006.01)

(52) U.S. Cl.
USPC ..... 225/103

(58) Field of Classification Search
USPC ..... 225/103, 104, 105, 93, 97; 30/162, 335, 30/124, 258, 278, 286; 83/580; 206/359
See application file for complete search history.

(56) References Cited

U.S. PATENT DOCUMENTS 4,063,481 A * 12/1977 Raudys et al. ..... 83/199
4,077,555 A * 3/1978 Jeff ..... 225/103
5,093,993 A * 3/1992 Nishiyama ..... 30/124
6,105,838 A * 8/2000 Hansen ..... 224/232

FOREIGN PATENT DOCUMENTS

JP 2007-252494 A 10/2007
JP 2009-039334 A 2/2009

* cited by examiner

*Primary Examiner* — Ghassem Alie
(74) *Attorney, Agent, or Firm* — Crowell & Moring LLP

(57) ABSTRACT

Disclosed is a blade snap-off holder which enables a safe, easy and smooth operation for snapping off a blade tip of a cutter knife. The holder has an insertion opening on its wall. A tip of a knife blade inserted through the opening is received in a groove of a rotary member located inside the holder. The rotation axis of the rotary member extends substantially parallel to the score of the knife blade. When the rotary member is rotated and a bending force is applied to the tip of the knife blade, the blade tip received in the groove of the rotary member can be snapped off. A user only grasps this holder in one hand and rotates the operation lever with a finger, and then a blade tip can be snapped off cleanly and easily without any subtle control of a force.

10 Claims, 3 Drawing Sheets

Prior Art

BLADE SNAP-OFF HOLDER

BACKGROUND OF THE INVENTION

1. Field of the Invention

The present invention relates to a holder for use with a cutter knife having a breakable blade, the holder being intended to snap off the tip of the breakable blade easily and to hold the snapped-off tip therein.

2. Description of the Related Art

A conventionally known breakable blade for use in a cutter knife or the like, as shown in FIG. 1, has a plurality of scores 5 (or grooves) along with the longitudinal direction of the blade 6 in parallel to one another. When the blade edge has become dull, the tip of the blade is snapped off along a score 5. Then, the new blade edge imparts sharpness like a new product.

For the blades of this type, many proposals hitherto have been made for safe disposal of the snapped-off tips of the blade.

The blade snap-off holders disclosed in JP-A-2009-039334 and JP-A-2007-252494 have a snapping slit formed on their body. That is, the tip of the blade is inserted into the slit, which penetrates through the side wall of the holder, and a bending force is applied to the blade, with a score on the blade being in alignment with the slit. Then, the blade tip is snapped off, and falls down into the holder through the slit.

SUMMARY OF THE INVENTION

In any of the conventional proposals, a user gets nervous a little when snapping off the blade tip.

That is, the user grips the holder in one hand and the cutter knife body in the other hand, with the blade tip inserted into the slit formed on the side wall of the holder, and then the user applies a bending force to the blade to snap off the tip. At that time, the bending force should be large to a certain degree, while subtle control of the force is needed, such that an excessive force would not cause the user's hands to hit on something and to be injured.

An object of the present invention is therefore to provide a blade snap-off holder, by which a safe, easy and smooth snapping-off operation can be achieved without any nervous caution.

The present invention provides a blade snap-off holder having the following features.

A holder of the present invention is for snapping off a tip of a knife blade and holding snapped-off tips therein, the knife blade having a plurality of scores thereon in parallel to one another at predetermined intervals, and the snapping off being conducted along one of the scores. The holder comprises:

an insertion opening into which the knife blade is inserted, a rotary member which has a groove for receiving the knife blade inserted into the insertion opening, and which is so arranged that its rotation axis extends in substantially parallel to the scores of the knife blade, and an operation means by which the rotary member is rotated to apply a bending force to the tip of the knife blade received in the groove of the rotary member, so as to snap it off.

Herein, the "score" means a groove-like break line formed on the blade. When a bending force is applied to the blade, the tip of the blade can be snapped off along the "score".

The "operation means" is not limited to particular one, as long as it can operate the rotary member to rotate to apply a bending force to a portion of the blade received in the groove of the rotary member, and snap it off.

According to the holder of the present invention constructed as above, a tip of a cutter knife blade can be easily snapped off with ease, only by inserting the cutter knife blade into the holder and operating the operation means to apply a bending force to the blade. During this operation of snapping-off, any subtle control of the force is not needed. In other words, a safe, easy and smooth blade snap-off operation can be achieved without a user's any nervous caution.

Further, the blade tips thus snapped off can be held in the holder without flying off, with no extra burden.

BRIEF DESCRIPTION OF THE DRAWINGS

These and other objects and features of the present invention will become apparent from the following description taken in conjunction with the preferred embodiments thereof with reference to the accompanying drawings.

DETAILED DESCRIPTION OF THE PREFERRED EMBODIMENTS

Figure 1:
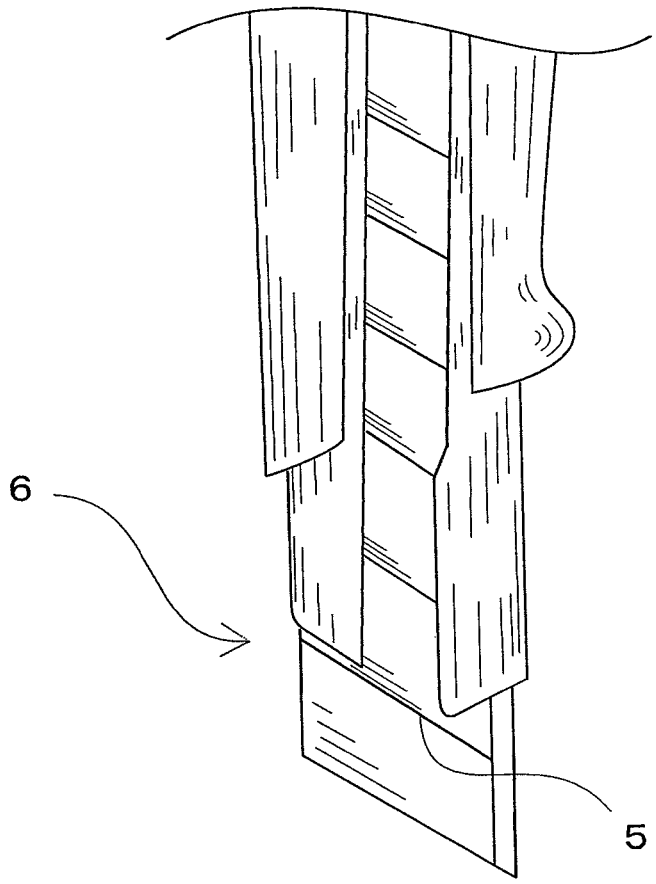
FIG. 1 shows a cutter knife having a breakable blade.
Figure 2:
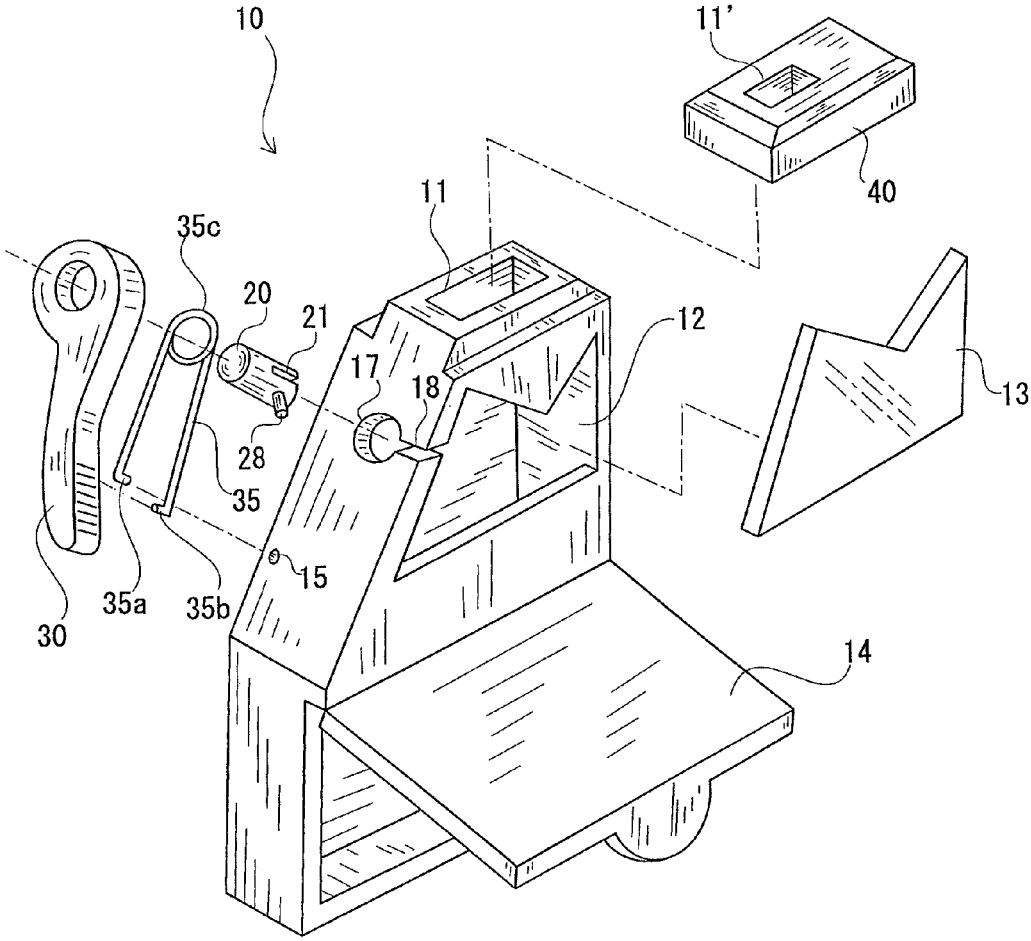
FIG. 2 shows an exploded perspective view of a blade snap-off holder according to an embodiment of the present invention.

FIG. 2 shows an exploded perspective view of a blade snap-off holder 10 according to an embodiment of the present invention. As shown in FIG. 2, an insertion opening 11 is formed on the top wall of the holder 10. The tip of a knife blade is inserted into the opening 11 (see FIG. 3).

Figure 3:
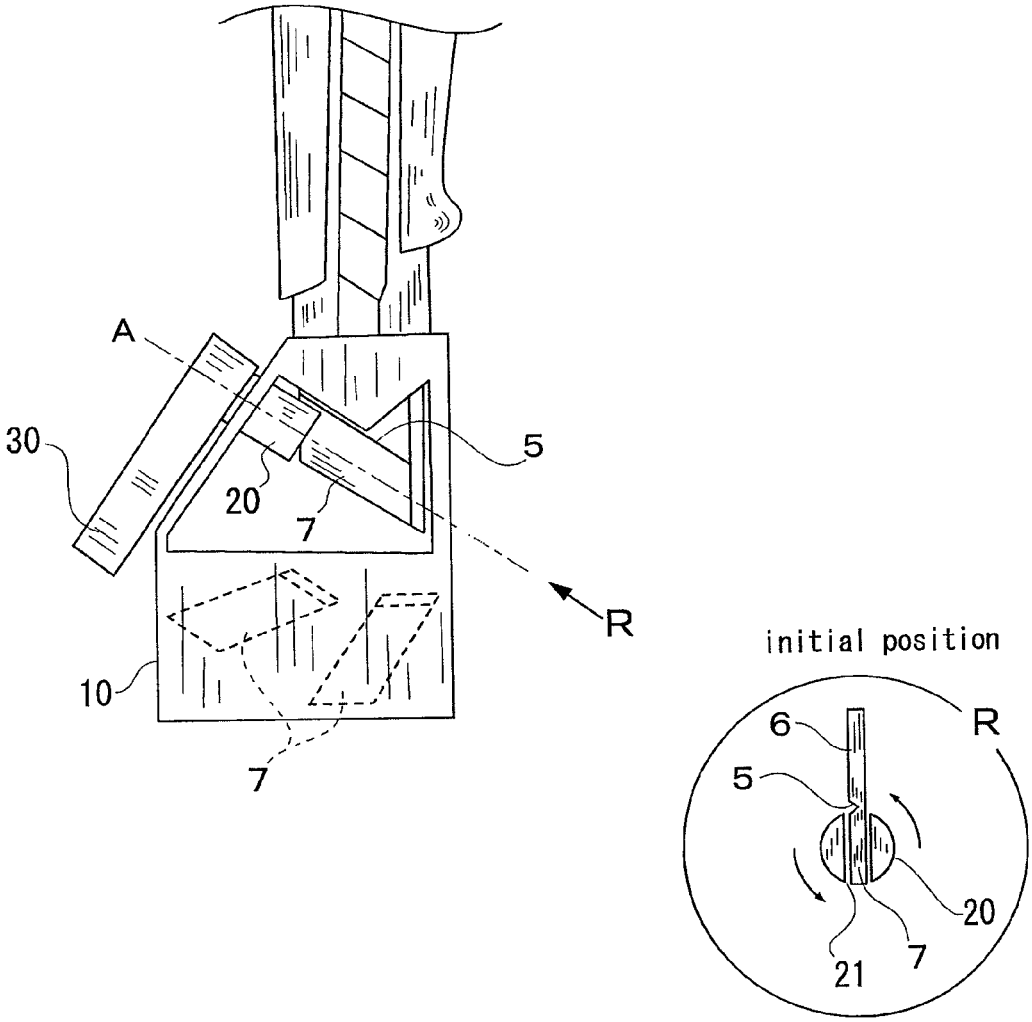
FIG. 3 shows the mechanism of the holder in FIG. 2 for snapping-off a blade tip.

In FIG. 2, the rotary member 20 is cylindrically shaped and is rotatable about a rotational axis "A" (see FIG. 3). An adhesive, press fitting or other suitable means can be employed to secure the rotary member 20 to the operation lever 30, such that the rotary member 20 would not rotate relatively to the operation lever 30.

The rotary member 20 extends into the holder 10 through an opening 17 formed on the side wall of the holder 10, and is operated by the operation lever 30 which is located outside the holder 10.

When inserting the rotary member 20 into the opening 17, the pin 28 projected from the rotary member 20 is passed through a slit 18 formed on the holder 10, and then the slit 18 is preferably closed to prevent the rotary member 20 from coming out.

The opening 12 formed on the front wall of the holder 10 is to be covered with a transparent plate 13, so as to serve as an inspection window. A cover 14 is provided under the inspection window, and the snapped-off tips 7 (FIG. 3) can be removed by opening the cover 14.

<<Mechanism for Snapping-Off a Blade Tip>>

As shown in FIG. 3, when the rotary member 20 is located inside the holder 10, the rotation axis "A" of the rotary member 20 extends substantially in parallel to the score 5 of the blade. A groove 21 is formed on an end of the rotary member 20. In this regard, as shown in the circle "R" in FIG. 3, a position at which the groove 21 is vertically directed is referred to as an "initial position".

The diagram in the circle "R" shows a positional relationship between the groove 21 of the rotary member 20 and the score 5 of the blade 6, when viewed in the direction of the arrow "R".

The rotary member 20 can be rotated by the operation lever 30, and when the rotary member 20 is at the "initial position", the blade 6 can proceed into the groove 21 from above in FIG.

3. From this condition, the rotary member 20 is rotated by the operation lever 30, and a bending force is applied to the tip 7 of the blade to snap off along the score 5.

The blade tips 7 snapped off can be held in the holder 10 without flying off. The blade tips 7 can be finally taken out by opening the cover 14 and then disposed in safe.

<<Spring 35>>

The spring 35 comprises two leg portions 35*a* and 35*b* and a coil-like head portion 35*c*. The head portion 35*c* is positioned around the rotary member 20. One leg portion 35*a* is inserted in the hole 15 on the side wall of the holder, and the other leg portion 35*b* is inserted in a hole (not shown) on the side face of the operation lever 30.

The spring 35 biases the operation lever 30 toward a certain particular position. In this regard, the shapes and the sizes of the respective members are so designed that the particular position corresponds to the above-described "initial position". This is described in detail: after the blade tip 7 has been snapped off by operating the operation lever 30, the user releases his or her finger, and then, a biasing force of the spring 35 causes the rotary member 20 to automatically return to the "initial position" shown in FIG. 3, which facilitates the next operation of snapping off a blade tip.

A concrete means for applying such the biasing force is not limited to the spring 35 having the shown shape, and any suitable resilient members can be employed.

<<Adaptor 40>>

The adaptor 40 shown in FIG. 2 is detachably attached to the holder 10, and covers the insertion opening 11. The adaptor 40 has an insertion opening 11' of a smaller size than the insertion opening 11 formed on the holder 10.

When the adaptor 40 is attached to the holder 10, although not shown in the figure, it becomes possible to insert a cutter knife blade of a smaller size into the insertion opening 11'. A position of the insertion opening 11' on the adaptor 40 is so designed that the blade tip can be snapped off in the same manner as described above.

Other Embodiments

In the shown embodiment, the operation lever 30 located outside the holder 10 is used as an operation means for rotating the rotary member 20.

However, in the present invention, the operation means for rotating the rotary member 20 can be of any type, as long as the operation means can rotate the rotary member 20 in any way to apply a bending force to a portion of the blade which is received in the groove 21 on the rotary member, and snap it off.

For example, within the holder 10, the rotary member 20 may be provided with a cam mechanism, and this cam mechanism may be used as an operation means. A cutter knife blade inserted into the insertion opening 11 cooperates with the cam mechanism (the operation means) to rotate the rotary member 20.

In this case, other than the shown portable holder, a desktop type holder may be possible, in which an insertion opening 11 is formed on top wall of the desktop type holder.

Preferably, a resilient member similar to the spring 35 shown in FIG. 2 is provided to bias the rotary member 20 toward the "initial position".

In still other embodiment, the rotary member 20 may be driven by a motor, and a start button or switch (i.e., the operation means) for the motor may be provided on the surface of the holder 10.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A holder for snapping off a tip of a knife blade and holding snapped-off tips therein, the knife blade having a plurality of scores thereon in parallel to one another at predetermined intervals, and the snapping off being conducted along one of the scores, the holder comprising:

an insertion opening into which the knife blade is insertable, a rotary member which has a groove for receiving a knife blade inserted into the insertion opening, wherein the rotary member is cylindrically shaped and wherein the rotary member is rotatable about a longitudinal axis of the rotary member, and an operation means by which the rotary member is rotated to apply a bending force to the tip of the knife blade received in the groove of the rotary member, so as to snap it off.

2. The holder according to claim 1, wherein the groove of the rotary member receives the knife blade, inserted into the insertion opening, at an initial position, and wherein the operation means is biased by a resilient member toward a position at which the rotary member is located at the initial position.

3. The holder according to claim 1, further comprising an adaptor which has a second insertion opening smaller than the insertion opening and which can selectively cover or uncover the insertion opening.

4. The holder according to claim 2 further comprising an adaptor which has a second insertion opening smaller than the insertion opening and which can selectively cover or uncover the insertion opening.

5. A holder for snapping off a tip of a knife blade and holding snapped-off tips therein, the knife blade having a plurality of scores thereon in parallel to one another at predetermined intervals, and the snapping off being conducted along one of the scores, the holder comprising:

an insertion opening into which the knife blade is insertable;

a rotary member which has a groove for receiving a knife blade inserted into the insertion opening, wherein the rotary member is cylindrically shaped and wherein the rotary member is rotatable about a longitudinal axis of the rotary member; and an operation lever, wherein the rotary member is rotatable by the operation lever.

6. The holder according to claim 5, wherein the groove of the rotary member has an initial position and wherein the operation lever is biased toward the initial position of the rotary member.

7. The holder according to claim 5 further comprising an adaptor which has a second insertion opening smaller than the insertion opening and wherein the insertion opening is selectively coverable and uncoverable by the adaptor.

8. A holder for snapping off a tip of a knife blade and holding snapped-off tips therein, the knife blade having a plurality of scores thereon in parallel to one another at predetermined intervals, and the snapping off being conducted along one of the scores, the holder comprising:

an insertion opening into which the knife blade is insertable;

a rotary member which has a groove for receiving a knife blade inserted into the insertion opening, wherein the rotary member is cylindrically shaped and wherein the rotary member is rotatable about a longitudinal axis of the rotary member; and means for rotating the rotary member.

9. The holder according to claim 8, wherein the groove of the rotary member has an initial position and wherein the means for rotating the rotary member is biased toward the initial position of the rotary member.

10. The holder according to claim 8 further comprising an adaptor which has a second insertion opening smaller than the insertion opening and wherein the insertion opening is selectively coverable and uncoverable by the adaptor.

* * * * *